United States Patent [19]

Macey

[11] Patent Number: 4,479,642

[45] Date of Patent: Oct. 30, 1984

[54] RECIPROCATING STITCHER ASSEMBLY OPERABLE ALONG SIGNATURE PATH

[75] Inventor: Keith S. Macey, Rocky River, Ohio

[73] Assignee: K. S. Macey Machine Company, Inc., Cleveland, Ohio

[21] Appl. No.: 381,529

[22] Filed: May 24, 1982

Related U.S. Application Data

[63] Continuation-in-part of Ser. No. 364,225, Apr. 1, 1982, abandoned.

[51] Int. Cl.[3] ..... B42B 1/02; B27F 7/08; B42C 1/12

[52] U.S. Cl. ..... 270/53; 227/100; 227/101; 227/155; 112/20; 412/33; 493/385

[58] Field of Search ..... 270/53–58, 270/37; 227/44, 45, 50, 81, 100–105, 140, 150, 155, 159; 412/33; 493/385; 112/20, 121.14, 121.17, 121.15

[56] References Cited

U.S. PATENT DOCUMENTS

| | | | |
|---|---|---|---|
| 2,998,116 | 8/1961 | Muller | 198/24 |
| 3,539,180 | 10/1970 | Zugel | 271/54 |
| 3,554,531 | 6/1971 | Heigl | 270/53 |
| 3,613,217 | 10/1971 | Perkins | 29/432.2 |
| 3,627,305 | 12/1971 | Heigl | 270/68 |
| 3,786,979 | 1/1974 | Muller | 227/44 |
| 4,236,706 | 12/1980 | Schlough | 270/53 |

*Primary Examiner*—E. H. Eickholt
*Attorney, Agent, or Firm*—Fay & Sharpe

[57] ABSTRACT

A binding apparatus includes a plurality of feed stations (10, 12, 14) which stack sheets on an inclined conveying surface (16). A conveyor (20) continuously conveys the stacks along a workpath (w) to a stitcher assembly (B). The stitcher assembly includes a frame assembly (100) having a stitcher head mounting bar (130) and a clincher mounting bar (136) on which stitcher heads and clinchers are mounted in cooperative relationship. A power take-off assembly (54) rotates a stitcher assembly transverse drive shaft (200) in coordination with advancement of the conveyor. The stitcher assembly transverse drive shaft rotates lever arms (210, 212) which are connected by connecting links (214, 216), with a stationary structure such that the frame assemby is cyclically reciprocated longitudinally along the workpath. A stitcher head actuating assembly (220) and a clincher actuating assembly (240) are driven by the stitcher assembly transverse drive shaft to cause the mounted stitcher heads and clinchers to be actuated at the same point in each reciprocation cycle. In this manner, a stitch is inserted in the same location in each conveyed stack.

21 Claims, 6 Drawing Figures

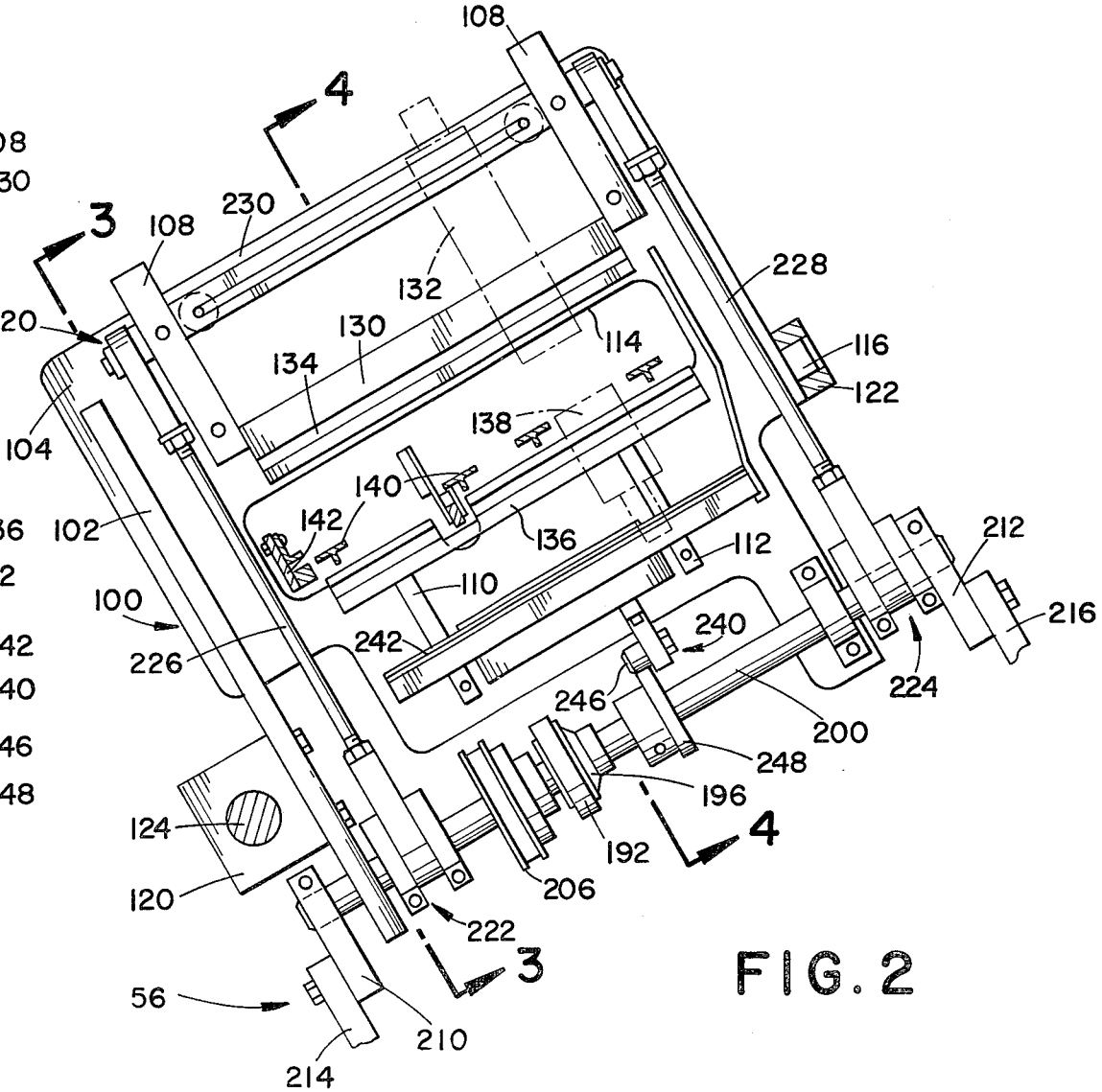
FIG. 2
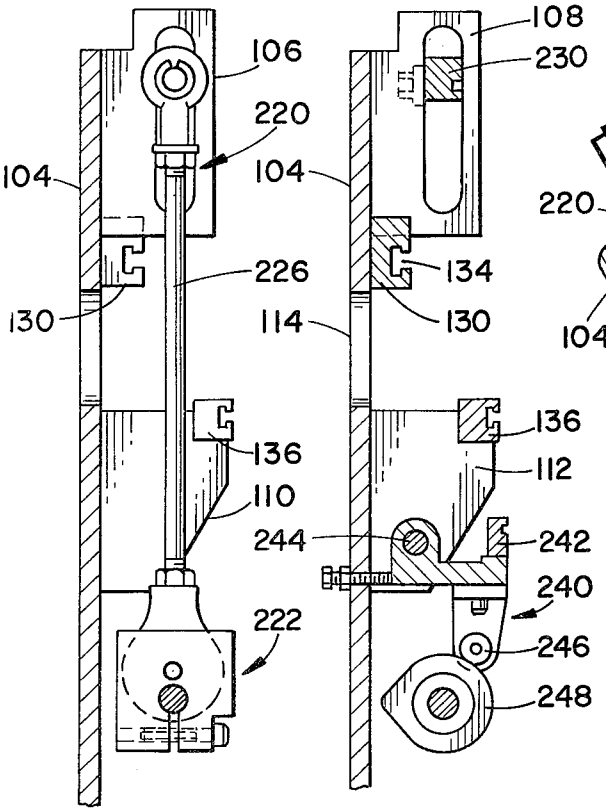
FIG. 3
FIG. 4

RECIPROCATING STITCHER ASSEMBLY OPERABLE ALONG SIGNATURE PATH

BACKGROUND OF THE INVENTION

This application is a continuation-in-part of application Ser. No. 364,255, filed Apr. 1, 1982 and entitled Reciprocating Stitcher Assembly and now abandoned.

This invention relates to the art of inserting fasteners into moving workpieces. The invention finds particular application in conjunction with automated binding machinery for stitching a plurality of printed sheets or pages in a desired stacked relationship with each other. Although the stitcher of the present invention is described in combination with automated binding machinery, it is to be appreciated that it has other applications including, for example, inserting stitches or other fasteners into workpieces moving along automated production equipment, pressure and heat bonding of moving workpieces, and the like.

Of many different prior binding apparatus or machines heretofore made available, one apparatus has found particularly significant commercial success. Such apparatus is shown and described in, for example, U.S. Pat. No. 3,554,531 to Heigl, et al. Briefly stated, this apparatus includes means for sequentially placing printed sheets into predetermined stacks at spaced intervals along a workpath defined by a continuously moving conveyor. The stacks are conveyed through caliper wheels adjacent the forward end of the conveyor for checking the thickness of each stack to confirm that a complete set of sheets is present. Each stack is then removed from the conveyor to a stationary stitcher assembly by means of a reciprocating shuttle mechanism. Following stitching, the stackes are moved to further processing stations along the workpath as required to complete a particular work requirement. Such additional processing stations may accommodate folding, trimming, sorting, collating, and the like.

Although the foregoing generally described binding apparatus has found commercial success, it does have certain practical drawbacks. For example, the apparatus includes a large number of moving parts which complicate manufacturing, while adding to subsequent adjustment and maintenance problems. Also, the general or overall versatility for the apparatus is reduced.

The present invention contemplates a new and improved automated binding apparatus which overcomes the above referenced problems and others. The invention provides such apparatus which has fewer moving parts, is more versatile, and is more economical to manufacture, adjust, and maintain.

SUMMARY OF THE INVENTION

In accordance with the present invention, a new stitcher assembly is provided for stitching together a plurality of workpieces as they are continuously conveyed longitudinally along a workpath. The stitcher assembly comprises a frame assembly, a workpiece supporting surface defining means, a frame assembly reciprocating means, a stitcher head actuating means, and a clincher actuating means. The frame assembly includes a stitcher head mounting means and a clincher mounting means which are adapted to mount at least one stitcher head and clincher in a cooperative relationship with each other. The surface defining means defines a workpiece supporting surface coextensive with the workpath intermediate the stitcher head mounting means and the clincher mounting means. The reciprocating means cyclically reciprocates the frame assembly longitudinally along the workpath in coordination with movement of the workpieces. The stitcher head actuating means is adapted to actuate at least one stitcher head mounted on the stitcher head mounting means. This actuating means is connected with the frame assembly and operatively connected with the reciprocating means for causing stitcher head actuation at a selected point in each reciprocation cycle. The clincher actuating means is adapted to actuate at least one clincher mounted on the clincher mounting means. This actuating means is also connected with the frame means and operatively connected with the reciprocating means for causing clincher actuation at substantially the same selected point in each reciprocation cycle as the stitcher.

According to a more detailed aspect of the invention, there is provided a binding apparatus which includes a feeding means for conveying stacks of sheets longitudinally along the workpath. The above described new stitcher assembly selectively stitches the conveyed stacks. Appropriate finishing means fold, turn, sort, and/or perform other finishing operations on the stitched stacks as may be required.

In accordance with still another aspect of the invention, a method for binding stacks of sheets is advantageously provided. The stacks are continuously conveyed longitudinally along a workpath at regular spaced apart intervals. At least one stitcher head and clincher are cyclically reciprocated longitudinally of the workpath in predetermined coordination with conveying of the stacks. Each reciprocation cycle occurs in phase with the advancement of the stacks by the regular spaced interval. The stitcher head and clincher are actuated at the same point at each reciprocation cycle such that each stack is stitched in substantially the same place.

The present invention is advantageous in that a new stitcher assembly is provided which is relatively economical and simple to manufacture and assemble.

Another advantage resides in the provision of a stitcher assembly which is easier to adjust and maintain.

Yet another advantage is a new method of stitching which is cost effective, reliable, and adapted to a variety of job requirements.

Still further advantages of the present invention will become apparent to those of ordinary skill in the art upon reading and understanding the following detailed description of the preferred embodiment.

BRIEF DESCRIPTION OF THE DRAWINGS

The invention may take form in various parts and arrangements of parts and in various method steps and arrangement of steps. The drawings are only for purposes of illustrating a preferred and one alternative embodiment of the invention and not to be construed as limiting same.

FIG. 2 is an elevational view of the stitcher assembly viewed in the direction of lines 2—2 of FIG. 1;

FIG. 3 is a cross-sectional view of the stitcher assembly drive taken along lines 3—3 of FIG. 2 with the stitcher head and clincher removed for ease of illustration;

FIG. 4 is a cross-sectional view taken along lines 4—4 of FIG. 2 with the stitcher head and clincher similarly removed for ease of illustration;

DETAILED DESCRIPTION OF THE PREFERRED EMBODIMENT

Figure 1:
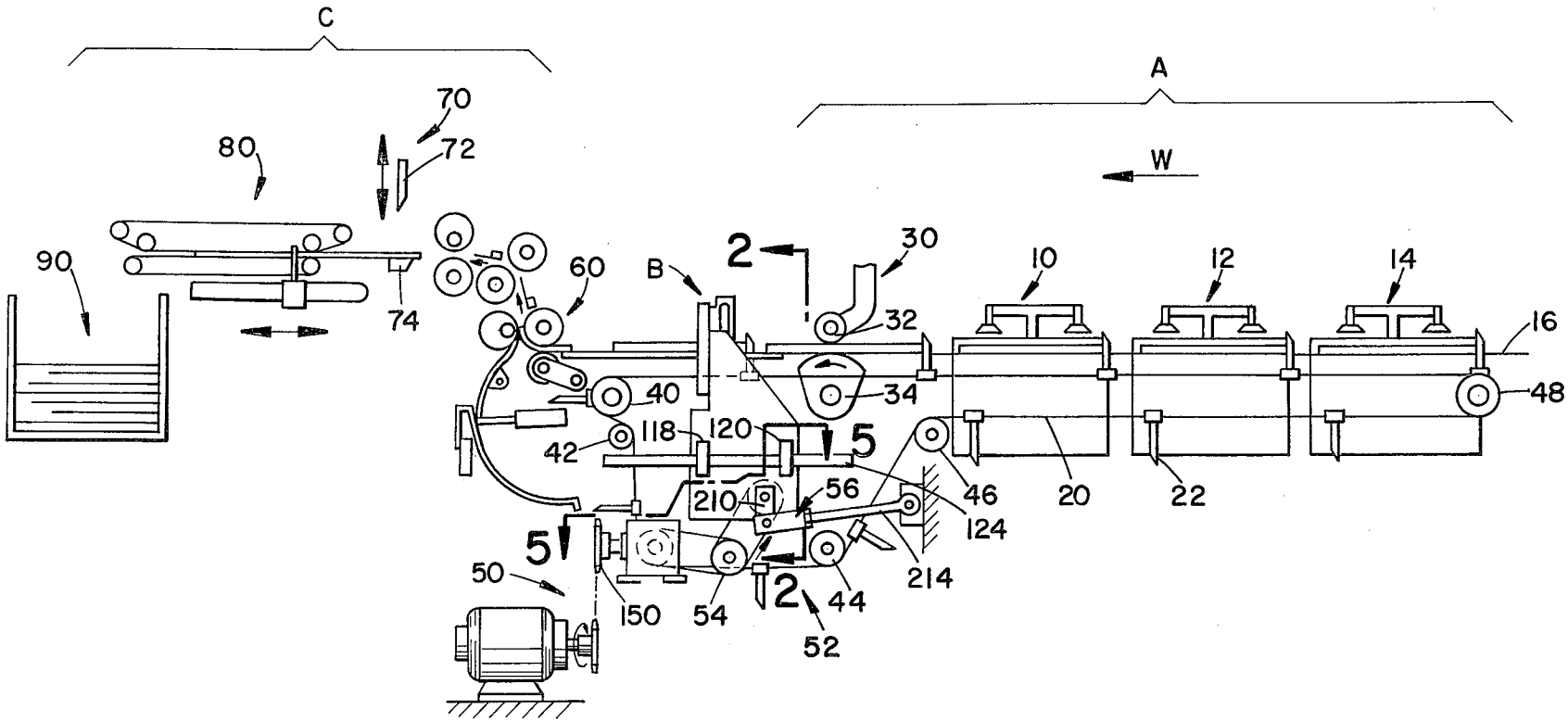
FIG. 1 is a diagrammatic illustration of an automated binding apparatus or machine formed in accordance with the present invention.

Referring now to the drawings wherein the showings are for purposes of illustrating the preferred and an alternate embodiment of the invention only and not for purposes of limiting same, FIG. 1 shows a feeding means A for continuously feeding stacks of sheets or other workpieces to be stitched longitudinally along a workpath in the direction of arrow w. A stitcher assembly B stitches the stacks as they are fed along the workpath to finishing means C which perform appropriate finishing operations on the bound stacks. Typically, the finished product comprises booklets, pamphlets, and the like.

The feeding means A includes a plurality of feed stations 10, 12, and 14, each of which includes known means for separating individual printed sheets from a source or pile and stacking them on other printed sheets moving along an inclined conveying surface 16. The conveying surface 16 is inclined at approximately 30° toward a lower rail (not shown in FIG. 1) against which the stacks are urged by gravity. Although only three feed stations are illustrated, it is to be appreciated that the actual number is commonly much larger. Specifically, the number of feed stations utilized matches the number of sheets to be bound.

A continuous chain conveyor 20 is provided and includes a plurality of regularly spaced dogs 22 extending through the inclined conveying surface 16. These dogs move sequentially past the feed stations at regular spaced intervals to engage and move or convey the sheets and resultant stacks of such sheets longitudinally along the workpath defined by the conveying surface 16. The chain dogs 22 move the stacks through an inspection station 30 which includes a pair of caliper wheels 32 and 34. These wheels determine whether or not the appropriate number of sheets are present in each stack.

The stitcher assembly B receives the continuously conveyed stacks from the inspection station 30. The stitcher assembly reciprocates longitudinally along the workpath, i.e., in the direction of travel of the conveyor 20, and undergoes one recirprocation cycle each time the conveyor advances by the regular spaced interval between adjacent ones of the dogs 22. At a selected point in each reciprocation cycle, the stitching assembly stitches the passing stack. The particular portion or area of the stack which receives the stitch is selected by coordinating the reciprocation cycle with the longitudinal position of the chain dogs 22.

Downstream from the stitcher assembly B, the chain conveyor turns on a sprocket 40. Thereafter, it moves along a return path including sprockets 42, 44, and 46, and then turns on another sprocket 48 to the rear of the feeder stations. Along the return run, the conveyor chain interacts with a drive means 50 and a reciprocating means 52 for cyclically reciprocating the stitcher assembly B longitudinally along the workpath in coordination with the longitudinal movement of the conveyor 20. The reciprocating means 52 includes a power take-off assembly 54, which comprises a dog leg belt drive arrangement in the preferred embodiment, and a reciprocating drive means 56 which drives the stitcher assembly B through the cyclic reciprocations with the power from the take-off means. The dog leg belt drive is connected with the drive means either directly or by way of the chain conveyor 20 and with the stitcher assembly to provide reciprocation driving power thereto.

The finishing means C includes a folding mechanism 60 which has two modes of operation and is disposed downstream from the stitcher assembly B. In one mode, each stitched stack is folded along the stitching for producing a book-like configuration and in the other mode, no folding occurs. A trimming assembly 70, including a face-trim knife 72 and a bed knife 74, is advantageously included for trimming the free edges of the stitched materials. A feeder assembly 80 is included for feeding the completed materials in a desired manner to a stacker 90 or other work collecting means. It will be appreciated that finishing stations 60, 70, 80, and 90 only comprise examples of ancillary binder apparatus to show the preferred use environment for the subject new stitcher assembly. Different or still other types of finishing stations may advantageously be incorporated without in any way departing from the overall intent or scope of the present invention.

With particular reference to FIG. 2 and secondary reference to FIGS. 3 and 4, the stitcher assembly B includes a frame assembly 100 having a side plate 102 and a back plate 104 fixedly secured in a normal relationship to each other. A pair of stitcher guides 106 and 108 having elongated guide slots therein are mounted to the back plate 104 such that the guide slots extend in a direction generally parallel to the plane of the back plate. A pair of clincher mounting plates 110 and 112 extend outwardly from the back plate in the same direction as the stitcher guides at areas located below a transversely extending plate opening 114. A longitudinal guide means including a follower 116 and bushings 118 and 120 constrain the frame assembly to reciprocate longitudinally, parallel to the workpath. The follower 116 extends outwardly from the back plate and is constrained to move along a longitudinal guide slot in a guide member 122. The guide member may be defined by a pair of bars or the like which are fixedly secured at their ends to, for example, the binding apparatus frame. The bushings 118 (FIG. 1) and 120 are mounted on the frame side plate 102 and slidably receive a longitudinal guide shaft 124.

A stitcher head mounting bar or means 130 adapted to mount one or more conventional stitcher heads 132 is affixed to the back plate 104 so as to extend transversely thereacross. The stitcher head mounting bar includes a T-slot 134 extending therealong so as to accommodate conventional stitcher head mounting as is known in the art. In the arrangement of the overall binding apparatus, the T-slot 134 facilitates adjustment of associated stitcher heads transversely of conveyor chain 20, i.e., transversely of the workpath. In the preferred environment of use for the subject new stitcher assembly, the stitcher heads 132 supply and insert metallic staple-like members into the stacks of printed materials being processed and bound.

A clincher mounting bar or means 136 is connected to the clincher mounting plates 110 and 112 so as to extend therebetween. The clincher mounting bar extends parallel to the stitcher head mounting bar 130 and is adapted to mount one or more conventional clinchers 138 in a cooperative relationship with the one or more stitcher heads 132. In the preferred environment, the clinchers fold over the free ends of the staple-like members.

A workpiece supporting surface defining means 140 extends longitudinally through the frame aperture 114 to support workpieces conveyed through the stitcher assembly. In the preferred embodiment shown, this surface defining means is comprised of a plurality of bars. Each of the bars is selectively removable for allowing a clincher to extend therebetween in close spaced relation to the remaining bars which define the workpiece supporting surface. The supporting surface defining means also includes a guide rail 142 at its downhill side against which the stacks are urged by gravity. The stacked sheets are maintained square and aligned by their sliding engagement along one edge with the guide rail and engagement on an adjacent edge with the associated chain dog 22.

Figure 5:
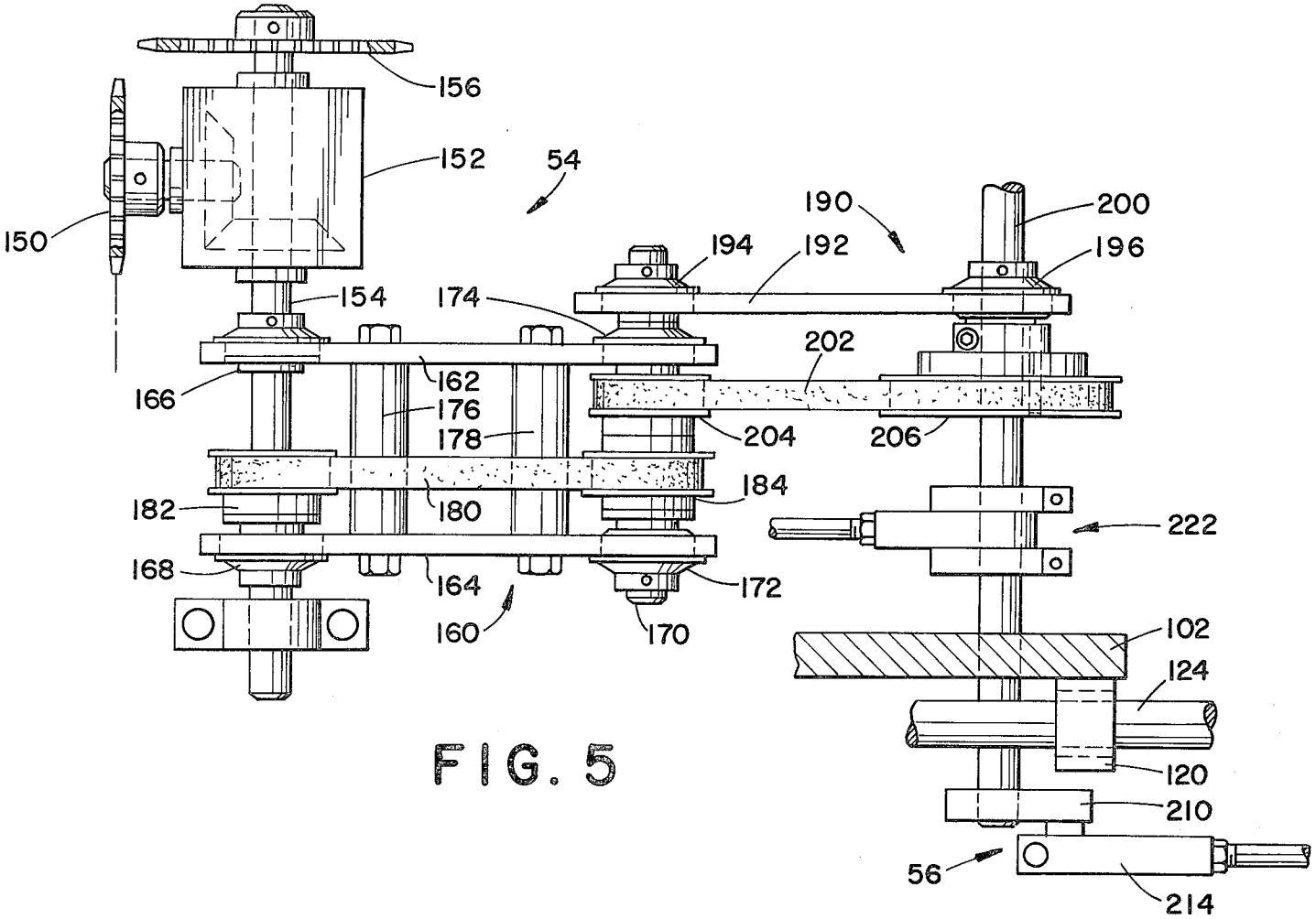
FIG. 5 is a cross-sectional view taken along lines 5—5 of FIG. 1.

With particular reference to FIG. 5 and with continuing reference to FIG. 1, the reciprocating means 52 causes the frame assembly to undergo a complete longitudinal travel and return cycle each time the conveyor 20 moves a distance equal to its interdog spacing. The power take-off 54 of the reciprocating means includes a sprocket 150 which is connected with the drive means 50 to be driven thereby. The sprocket 150 is connected by a transmission 152 with a transverse, frame mounted drive shaft 154. A conveyor chain sprocket 156 is mounted on the frame drive shaft for propelling the conveyor chain 20.

A first leg assembly 160 is pivotally mounted on the frame drive shaft. The first leg assembly 160 includes a pair of side brackets 162 and 164 which are pivotally mounted on the frame drive shaft at one end by bearings 166 and 168. The first leg assembly side brackets are pivotally mounted at their other ends with a free moving shaft 170 by means of bearings 172 and 174. Spacers 176 and 178 connect the first leg assembly side brackets to fix the free moving shaft 170 into a parallel relationship with the frame drive shaft 154. A first flexible drive means, such as a toothed timing belt 180, extends between a first pulley 182 and a second pulley 184 which are connected with the frame drive shaft and the free moving drive shaft 170, respectively, to transmit motive power to the free moving drive shaft.

A second leg assembly 190 includes a side bracket 192 which is pivotally mounted at one end by a bearing 194 with the free floating drive shaft 170 and is pivotally mounted at its other end by a bearing 196 with a stitcher assembly transverse drive shaft 200. A second, flexible drive means, such as a second toothed timing belt 202, extends between a third pulley 204 which is connected to the free moving shaft 170 and a fourth pulley 206 which is releasably connected to stitcher assembly transverse drive shaft 200. The releasable connection allows the relationship between the frame assembly reciprocation cycle and the chain dogs to be adjusted which, in turn, facilitates longitudinal adjustment of the stitch receiving area in the stacks.

With reference to FIGS. 1, 2, and 5, the reciprocating drive means 56 converts the rotary motion of the stitcher assembly drive shaft 200 into a reciprocating drive force for driving the frame assembly through the cyclic reciprocations. The reciprocating drive means includes a pair of lever arms 210 and 212 attached to either end of the stitcher assembly drive shaft 200 for rotation therewith. A pair of connecting links 214 and 216 are mounted between the free ends of the lever arms and a stationary structure, e.g., the conveyor frame or the like. In this manner, rotation of the stitcher assembly transverse drive shaft and the lever arms drive the frame assembly cyclically back and forth along the guide menas with simple harmonic motion.

With particular reference to FIG. 3 and continuing with reference to FIG. 2, a stitcher head actuating means 220 is adapted to actuate the one or more stitcher heads which are mounted on the stitcher head mounting bar 130. The stitcher head actuating means includes a pair of eccentric connecting means 222 and 224, such as a pair of cranks or the like, which are mounted on the transverse drive shaft 200 to move stitcher head actuating shafts 226 and 228 cyclically through a fixed throw as the transverse shaft rotates. A stitcher head actuating bar 230, which rides in the guide slots of stitcher guides 106 and 108, is connected across the actuating shafts. The eccentric connecting means are dimensioned such that the stitcher head actuating bar 230 moves in the guide slots over a throw of approximately two inches. In this manner, the stitcher head actuating means actuates the one or more stitcher heads 132 in a conventional manner in coordination with the conveyer chain 20 such that the stitches are driven into substantially the same pre-selected location in each stack of sheets being stitched.

With particular reference to FIG. 4 and continuing with reference to FIG. 2, a clincher actuating means 240 is adapted to actuate clinchers mounted on the clincher mounting bar. The clincher actuating means includes a clincher actuator bar 242 which is mounted by a pivot 244 on the clincher mounting plates 110 and 112. A clincher cam follower 246 depends from the clincher actuating bar 242 to engage a clincher eccentric means or cam 248 mounted on the stitcher assembly tranverse drive shaft 200 for rotation therewith. The clincher cam has a single lobe which is positioned relative to the angular position of the tranverse drive shaft 200 and the stitcher eccentric mountings 222 and 224 such that it actuates the clinchers to clinch or fold the ends of the stitches immediately upon their insertion by the stitcher heads through the stack of sheets.

In this manner, as stacks of sheets to be stitched move continuously along the conveyor 20, the stitcher assembly B accelerates and moves longitudinally along the workpath w with each stack of sheets to be stitched. As both the stitcher assembly and stacks of sheets are moving, the stitcher head and clinchers come into alignment with the pre-selected area of the stacked sheets in which the stitch is to be inserted. The relative position of the chain dogs and the stitcher head and clincher actuating means are selected such that the stitcher heads come into alignment with the pre-selected stitch receiving area before the stitcher assembly reaches its maximum longitudinal speed. As the stitcher head and clincher insert and clinch the stitch, the stitcher assembly accelerates longitudinally, advancing the stack slightly ahead of the associated chain dog. When the stitch is completed, the stack is released, allowing it to fall back against the chain dog. In this manner, a precise matching between the speed of the stitcher assembly and the conveyor is not required.

To change the stitch receiving area longitudinally of the workpath, the fourth pulley 206 is released from the stitcher assembly transverse drive shaft 200. The relationship between the stitcher assembly and the chain dogs is adjusted and the fourth pulley and stitcher assembly drive shaft are reconnected. Further, the stitcher heads and clincher can be slid transversely, along their respective mounting bars, to position them at different transverse coordinates. In this manner, a wide variety of stitch receiving area specifications are accommodated.

Figure 6:
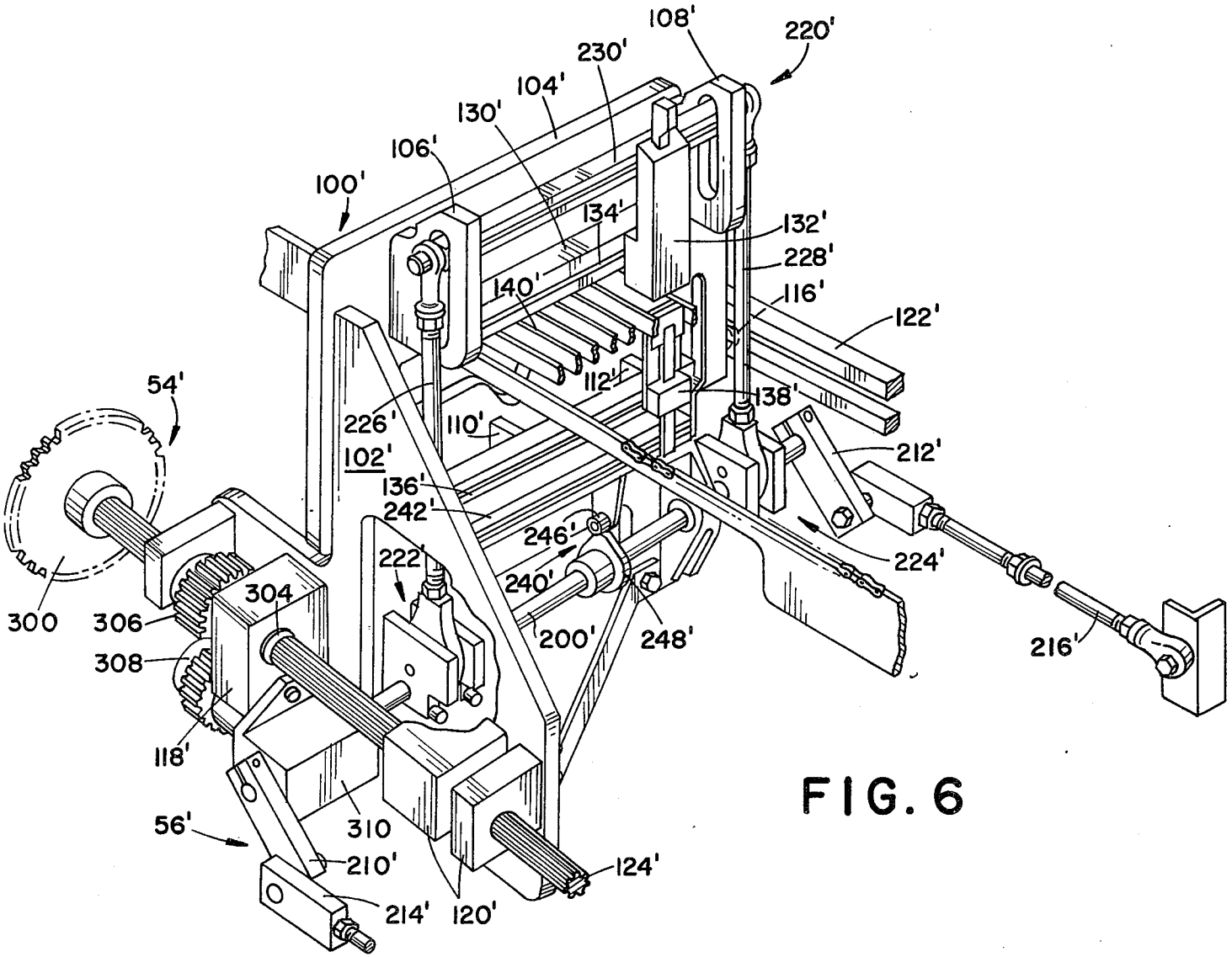
FIG. 6 is a perspective view of an alternate embodiment of the stitcher assembly constructed in accordance with the present invention.

FIG. 6 illustrates an alternate embodiment of a stitcher assembly constructed in accordance with the present invention. In the embodiment of FIG. 6, like elements with the embodiment of FIGS. 1–5 are denoted with the same reference numeral but followed by a prime (') suffix.

In FIG. 6, the stitcher assembly includes a frame assembly 100' including a side plate 102', a back plate 104', a pair of stitcher guides 106' and 108', and a pair of clincher mounting plates 110' and 112'. A longitudinal guide means includes a follower 116' extending outwardly from the back plate to engage a guide slot 122' and a pair of bushings 118' and 120' extending outwardly from the side plate to engage a guideshaft 124'. A stitcher mounting bar or means 130' which is affixed to the back plate 104' is adapted to mount one or more conventional stitcher heads 132' in a T-shaped mounting slot 134'. A clincher mounting bar or means 136' is mounted on the clincher mounting plates 110' and 112' parallel to the stitcher head mounting bar. The clincher mounting bar is adapted to mount one or more conventional clinchers 138' in a cooperative relationship with the one or more stitcher heads. A plurality of bars define a workpiece supporting surface 140' extending longitudinally of back plate aperture 114'.

A power take-off assembly 54 of a reciprocating means 52' includes a sprocket 300 which is connected to the drive means in coordination with the chain conveyor 20 to be driven therewith. The sprocket 300 rotates the longitudinal shaft 124' which, in the embodiment of FIG. 6, is splined. The bushing 118' includes a splined sleeve 304 which meshes with the splines on the shaft 124'. The splined sleeve 304 is connected by a pair of gears 306 and 308 and a transmission means 310 with a stitcher assembly transverse drive shaft 200'. In this embodiment, the splined shaft 124' and the transverse drive shaft 200' are connected with a 1:1 gear ratio such that the splined shaft rotates 360° with each cyclic reciprocation of the frame assembly. A reciprocating drive means 56' includes a pair of lever arms 210' and 212' which are connected to opposite ends of the transverse drive shaft 200'. A pair of connecting links 214' and 216' are mounted between the free ends of the lever arms and some fixed structure, e.g., the conveyor frame. Thus, the transverse drive shaft is rotated by the power take-off, and the reciprocating drive means converts the rotational movement into cyclic reciprocations of the stitcher assembly B.

A stitcher head actuating means 220' includes a pair of eccentric connecting means 222' and 224' such as a pair of cranks mounted on the stitcher assembly transverse drive shaft 200'. Stitcher head actuating shafts 226' and 228' are connected between the eccentric connecting means and a stitcher head actuating bar 230' to move it through a fixed throw in coordination with rotation of the transverse drive shaft. A clincher actuating means 240' includes a clincher actuating bar 242' which is pivotally mounted on the clincher mounting plates 110' and 112'. A clincher cam follower 246' depends from the clincher actuating bar 242' to engage a clincher eccentric means or cam 248' which is mounted on the transverse drive shaft 200' for rotation therewith. The clincher cam has a single lobe which is positioned in coordination with the angular position of the eccentric mounting means 222' and 224' on the stitcher assembly transverse drive shaft. The clincher cam and the stitcher eccentric means are coordinated to actuate the clinchers to clinch or fold the ends of the stitches immediately upon their insertion by the stitcher heads through the stack or sheets.

Although the invention is described in terms of the preferred and alternate embodiments, it is to be appreciated that other fastener inserting structures can be mounted and actuated by the stitcher head and clincher mounting means and by the associated actuating means. For example, the stitcher head mounting means can mount a rivet inserting head and the stitcher head actuating means can actuate it. As another example, the stitcher head mounting and actuating means can mount and press a heated metal element against conveyed plastic workpieces to heat-weld them. Similarly, the clincher mounting and actuating means can mount and actuate a rivet crimping means, a platen, or the like.

The invention has been described with reference to the preferred and alternate embodiments. Obviously, further modifications and alterations will occur to others upon reading and understanding the preceding detailed description of the preferred embodiment. It is intended that the invention be construed as including all such alterations and modifications insofar as they come within the scope of the appended claims or the equivalents thereof.

Having thus described the invention, it is now claimed:

1. A stitcher assembly for stitching workpieces which are being conveyed longitudinally along a workpath, said assembly comprising:

a frame assembly having a longitudinal axis extending therethrough and including a stitcher head mounting means and a clincher mounting means which are adapted to mount at least one stitcher head and clincher in a cooperative relationship to the frame assembly;

surface defining means for defining a workpiece supporting surface extending longitudinally through the frame assembly generally intermediate the stitcher head mounting means and the clincher mounting means;

reciprocating means for cyclically reciprocating the frame assembly generally along the workpath in coordination with movement of the conveyed workpiece along the workpath;

a stitcher head actuating means which is adapted to actuate at least one stitcher head mounted on the stitcher head mounting means, the stitcher head actuating means being operatively connected with the frame assembly and operatively connected with the reciprocating means to cause stitcher head actuation at a selected point in each reciprocation cycle; and, a clincher actuating means which is adapted to actuate at least one clincher mounted on the clincher mounting means, the clincher actuating means being operatively connected with the frame assembly and operatively connected with the reciprocating means to actuate the clinchers at substantially said selected point in each reciprocation cycle.

2. The stitcher assembly as set forth in claim 1 wherein the surface defining means includes a plurality of support bars, each of the support bars being selectively removable from association with the stitcher assembly to accommodate positioning of a clincher.

3. The stitcher assembly as set forth in claim 1 wherein the reciprocating means includes a reciprocating drive means operatively connected to a power take-off assembly for driving the frame assembly through the cyclic reciprocations.

4. The stitcher assembly as set forth in claim 3 wherein the reciprocating drive means drives the frame assembly with simple harmonic motion.

5. The stitcher assembly as set forth in claim 3 wherein the reciprocating drive means includes: a lever arm means mounted at one end on a transverse drive shaft having an axis transverse to the longitudinal axis for rotation around the transverse axis, the transverse drive shaft being operatively connected with the power take-off assembly to be driven thereby; and, a connecting link connected with the other end of the lever arm means, such that rotation of the lever arm drives the frame assembly cyclically along the longitudinal axis.

6. The stitcher assembly as set forth in claim 5 wherein the transverse drive shaft is rotatably mounted on the frame assembly and the connecting link is connected adjacent one end with a stationary structure and wherein the stitcher head actuating means and the clincher actuating means are operatively connected with the transverse drive shaft to synchronize stitcher head and clincher actuation with rotation of the transverse drive shaft.

7. The stitcher assembly as set forth in claim 3 further including a transverse drive shaft rotatably mounted on the frame assembly transverse to the longitudinal shaft, the transverse drive shaft being operatively connected with the reciprocating drive means to be rotated in coordination with the reciprocating movement of the frame assembly.

8. The stitcher assembly as set forth in claim 7 further including a first eccentric connecting means for connecting the transverse drive shaft and the stitcher head actuating means to cause the stitcher head actuation at a selected rotational position of the transverse drive shaft.

9. The stitcher assembly as set forth in claim 8 further including a second eccentric means for connecting the transverse drive shaft and the clincher actuating means to cause clincher actuation at a selected rotational position of the transverse drive shaft.

10. The stitcher assembly as set forth in claim 7 wherein the power take-off means includes a dog leg arrangement operatively connected between the transverse drive shaft and a frame mounted drive shaft for transferring motive power from the frame drive shaft to the transverse drive shaft.

11. The stitcher assembly as set forth in claim 10 wherein the dog leg assembly includes a first leg pivotally connected between the frame drive shaft and a free moving shaft and a second leg assembly pivotally connected between the free moving shaft and the transverse drive shaft, the first leg assembly including a flexible drive means connecting the frame drive shaft and free moving shaft such that the free moving shaft is caused to rotate with the frame drive shaft and wherein the second leg assembly includes a second flexible drive means connected between the free moving shaft and the transverse drive shaft such that the transverse drive shaft is rotated with the free moving shaft, whereby power is conveyed from the frame drive shaft to the transverse drive shaft.

12. The stitcher assembly as set forth in claim 11 wherein the first and second flexible drive means are toothed belts.

13. The stitcher assembly as set forth in claim 3 wherein the power take-off assembly includes a splined shaft which is rotated in coordination with the movement of the conveyed workpieces and a splined bushing slidably mounted on the longitudinal shaft to slide longitudinally therealong while being rotated thereby, the splined bushing being operatively connected with the transverse drive shaft.

14. A binding apparatus comprising:

(a) a feeding means for continuously conveying stacks of sheets along a workpath;

(b) a stitcher assembly for stitching the stacks, the stitcher assembly including:

(i) a frame assembly including a stitcher head mounting means and a clincher mounting means to which at least one stitcher head and clincher are mounted in a cooperative relationship;

(ii) surface defining means for defining a stack supporting surface extending through the frame assembly longitudinally along said workpath between the stitcher head and the clincher;

(iii) reciprocating means for cyclically reciprocating the frame assembly longitudinally along said workpath in coordination with the movement of the conveyed stacks along said workpath;

(iv) a stitcher head actuating means for actuating the stitcher head, the stitcher head actuating means being operatively connected with the frame assembly and operatively connected with the reciprocating means to cause stitcher head actuation at a selected point in each reciprocation cycle;

(v) a clincher actuating means for actuating the clincher, the clincher actuating means being operatively connected with the frame assembly and operatively connected with the reciprocating means to actuate the clinchers at substantially said selected point in each reciprocation cycle; and, (c) finishing means for finishing the stitched stacks.

15. The binding apparatus as set forth in claim 14 wherein the feeding means includes a conveyor which has projecting dogs for engaging the stacks, the conveyor extending through the stitcher assembly coextensive with the workpath to convey the stacks therealong.

16. The binding apparatus as set forth in claim 15 further including means for coordinating the movement of the conveyor and the stitcher assembly reciprocating means.

17. The binding apparatus as set forth in claim 14 wherein the reciprocating means includes a reciprocating drive means operatively connected with a power take-off assembly for driving the frame assembly through the cyclic reciprocations.

18. The binding apparatus as set forth in claim 17 further including a stitcher assembly transverse drive shaft rotatably mounted on the frame assembly and operatively connected with the power take-off assembly to be rotated thereby in coordination with reciprocation of the frame assembly and wherein the stitcher head actuating means and the clincher actuating means are operatively connected with the stitcher assembly transverse drive shaft to synchronize stitcher head and clincher actuation with rotation of the stitcher assembly transverse drive shaft.

19. The binding apparatus as set forth in claim 18 wherein the reciprocating drive means includes: a lever arm means mounted at one end on the stitcher assembly transverse drive shaft for rotation around the transverse axis, and a connecting link mounted between the other end of the lever arm means and a stationary structure, such that rotation of the lever arm drives the frame assembly through the cyclic reciprocations.

20. The binding apparatus as set forth in claim 18 wherein the power take-off assembly includes a first leg assembly pivotally connected at one end with a frame mounted drive shaft and pivotally connected at its other end with a free moving shaft, and a first drive means connecting the frame mounted drive shaft and the free moving shaft such that the free moving shaft is rotated with the frame mounted drive shaft; and a second leg assembly which is pivotally mounted at one end with the free moving shaft and pivotally mounted at its other end with the stitcher assembly transverse drive shaft and a second drive means connected between the free moving shaft and the stitcher assembly transverse drive shaft such that the stitcher assembly transverse drive shaft is rotated with the free moving shaft.

21. The binding apparatus as set forth in claim 17 wherein the power take-off means rotates a splined, longitudinal shaft disposed parallel to the workpath in coordination with the advancement of the conveyor and a splined bushing slidably mounted on the splined shaft for transmitting rotational motion from the splined shaft to the stitcher assembly transverse drive shaft.

* * * * *